United States Patent [19]

Uchida et al.

[11] Patent Number: 4,983,944

[45] Date of Patent: Jan. 8, 1991

[54] ORGANIC POSITIVE TEMPERATURE COEFFICIENT THERMISTOR

[75] Inventors: Katsuyuki Uchida; Haruo Takahata, both of Nagaokakyo, Japan

[73] Assignee: Murata Manufacturing Co., Ltd., Japan

[21] Appl. No.: 498,285

[22] Filed: Mar. 23, 1990

[30] Foreign Application Priority Data

Mar. 29, 1989 [JP] Japan ..... 1-79885

[51] Int. Cl.[5] ..... H01C 7/10

[52] U.S. Cl. ..... 338/22 R; 219/548; 219/553

[58] Field of Search ..... 338/22 R, 22 SD; 219/541, 544, 545, 546, 548, 552, 553, 549; 374/185

[56] References Cited

U.S. PATENT DOCUMENTS

| | | | |
|---|---|---|---|
| 4,149,066 | 4/1979 | Niibe | 338/22 R X |
| 4,330,703 | 5/1982 | Horsma et al. | 338/22 R X |
| 4,733,057 | 3/1988 | Stanzel et al. | 219/548 |

*Primary Examiner*—Bruce A. Reynolds
*Assistant Examiner*—Marvin M. Lateef
*Attorney, Agent, or Firm*—Ostrolenk, Faber, Gerb & Soffen

[57] ABSTRACT

An organic positive temperature coefficient thermistor in which a plurality of spaced, substantially parallel conductive portions extend between first and second opposed side edges of a sheet made of a material, exhibiting a positive temperature characteristic of resistance, which is composed of conductive particles disposed in an organic polymer material. The conductive portions may also extend between the vicinities of the side edges. A plurality of insulating layers are formed so as to alternately coat the vicinities of respective first ends of the conductive portions at the first or second side edges or in the vicinity of the side edge. First and second power feeding electrodes are respectively formed along the first and second side edges so as to extend on the insulating layers and on the conductive portions located between the insulating layers to electrically connect the respective ends of the conductive portions.

11 Claims, 5 Drawing Sheets

ORGANIC POSITIVE TEMPERATURE COEFFICIENT THERMISTOR

BACKGROUND OF THE INVENTION

1. Field of the Invention

The present invention relates generally to organic positive temperature coefficient (PTC) thermistors used as face-like heating devices, and more particularly, to an organic positive temperature coefficient thermistor which includes an improvement in the structure of electrodes formed on a sheet exhibiting a positive temperature characteristic of the resistance.

2. Description of the Prior Art

For example, a material obtained by thoroughly mixing a polyolefin such as polyethylene with conductive particles such as carbon black, metal powder or carbon graphite exhibits a positive temperature characteristic of resistance. An organic positive temperature coefficient thermistor using a sheet made of this material can be used as a flexible face-like heating device.

An example of the above described organic positive temperature coefficient thermistor is shown in FIG. 1. In an organic positive temperature coefficient thermistor 1, comb-shaped electrodes 3 and 4 are formed on one surface of a sheet 2 obtained by dispersing conductive particles in an organic polymer material such as polyolefin. The comb-shaped electrodes 3 and 4 respectively comprise power feeding electrodes 3*a* and 4*a* extending along side edges of the sheet 2 and a plurality of conductive portions 3*b* and 4*b* extending from the power feeding electrodes 3*a* and 4*a* toward the respective other power feeding electrodes 4*a* and 3*a*. The plurality of conductive portions 3*b* and 4*b* are arranged so as to be interdigitated.

In the organic positive temperature coefficient thermistor 1 shown in FIG. 1, heat is uniformly generated to some extent in the region where the plurality of conductive portions 3*b* and 4*b* are interdigitated. However, the region where the power feeding electrodes 3*a* and 4*a* are arranged along the side edges of the sheet 2 hardly contributes to heat generation. Consequently, heat cannot be efficiently generated in the entire sheet 2, thereby making it impossible to obtain satisfactory thermal efficiency.

Another organic positive temperature coefficient thermistor, having a structure in which an electrode is formed over both surfaces of a sheet 2 shown in FIG. 1, is known, but is not illustrated herein. In this organic positive temperature coefficient thermistor, heat is uniformly generated on the whole surface of the sheet 2. Consequently, this organic positive temperature coefficient thermistor is superior in thermal efficiency to the positive temperature coefficient thermistor shown in FIG. 1. However, if the whole surface electrode is formed of, for example, a metal foil, there are differences in the coefficient of thermal expansion and in flexibility between the sheet and the metal foil. Accordingly, the flexibility which is an advantage of the organic positive temperature coefficient thermistor is lost.

Furthermore, if the whole surface electrode is formed of a conductive paste such as an Ag paste, the organic positive temperature coefficient thermistor is substantially increased in cost, although it retains its flexibility.

Another problem is that in the organic positive temperature coefficient thermistor with the whole surface electrode, the resistance value of the whole thereof becomes lower than that of the organic positive temperature coefficient thermistor in which the comb-shaped electrodes 3 and 4 are formed. Accordingly, the specific resistance of the sheet must be increased by approximately tenfold to hundredfold that of the organic positive temperature coefficient thermistor in which the comb-shaped electrodes are formed. If the specific resistance of the organic positive temperature coefficient thermistor is thus increased, however, the stability of the specific resistance is lost, resulting in increased variation in specific resistance. As a result, the organic positive temperature coefficient thermistor varies very greatly in characteristics depending on the product.

SUMMARY OF THE INVENTION

Accordingly, an object of the present invention is to provide an organic positive temperature coefficient thermistor which uniformly generates heat and, thus, is superior in thermal efficiency, does not vary greatly in characteristics depending on the product, and retains its flexibility.

In an organic positive temperature coefficient thermistor according to the present invention, a plurality of conductive portions are arranged substantially parallel with each other on the surface of a sheet made of a material exhibiting a positive temperature characteristic of resistance obtained by dispersing conductive particles in an organic polymer material so as to extend between first and second side edges opposed to each other of the sheet or between the vicinities of the side edges.

A plurality of insulating layers are arranged so as to alternately coat one end or the other of each conductive portion so that alternate ones of the ends of the conductive portions at the first side edge and alternate ones of the conductive portions at the second side edge are coated with respective insulating layers.

Furthermore, first and second power feeding electrodes are respectively formed along the first and second side edges so as to extend on the insulating layers and on the conductive portions located between the insulating layers in order to electrically connect the respective ends of the conductive portions located between the insulating layers.

According to the present invention, the plurality of conductive portions contributing to heat generation extend between the first and second side edges of the sheet or between the vicinities of the side edges. Accordingly, heat is uniformly generated in the entire region or almost the entire region between the first and second side edges. Consequently, an organic positive temperature coefficient thermistor superior in thermal efficiency can be obtained.

Furthermore, an electrode is not provided on the whole surface. Accordingly, even if the conductive portions contributing to heat generation are formed of metal foils, the flexibility which is an advantage of the organic positive temperature coefficient thermistor is not lost. In addition, even if the plurality of conductive portions are formed of expensive conductive pastes, the organic positive temperature coefficient thermistor is not high in cost, unlike the organic positive temperature coefficient thermistor in which an electrode is formed on the whole surface.

Therefore, a low-cost face-like heating device which is superior in thermal efficiency and flexibility and does not vary greatly in characteristics depending on the product can be provided by using the organic positive temperature coefficient thermistor according to the present invention.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 2A:
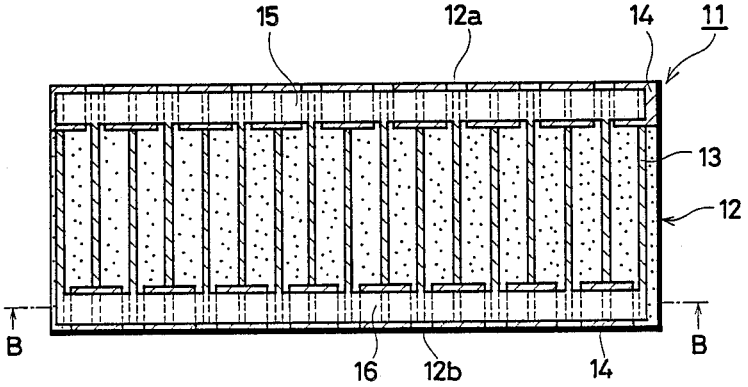
FIG. 2A is a plan view for showing an organic positive temperature coefficient thermistor according to a first embodiment of the present invention.
Figure 2B:
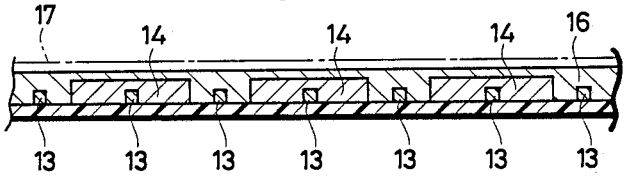
FIG. 2B is a cross-sectional view taken along a line B—B shown in FIG. 2A.

FIG. 2A is a plan view illustrating an organic positive temperature coefficient thermistor according to a first embodiment of the present invention, and FIG. 2B is a cross sectional view taken along a line B—B shown in FIG. 2A.

An organic positive temperature coefficient thermistor 11 uses a sheet 12 exhibiting a positive temperature characteristic of resistance constructed by dispersing conductive particles in an organic polymer material.

As the organic polymer material, a polyolefin such as polyethylene may illustratively be used. In addition to this, any other organic polymer material can be used provided that conductive particles can be dispersed therein. Furthermore, other conductive materials, such as carbon black, metal powder or carbon graphite, can be used as conductive particles. In general, the conductive particles are thoroughly mixed with the organic polymer material and formed by a suitable molding method, thereby to obtain the sheet 12.

Furthermore, a sheet formed by applying on an insulating film or an insulating plate a paste-like organic positive temperature coefficient thermistor material obtained by dispersing conductive particles in an organic polymer material and then, thoroughly mixing a solvent with the organic polymer material may be used as the sheet 12. The solvent for making the organic positive temperature coefficient thermistor like a paste can be varied depending on the organic polymer material.

Figure 3:
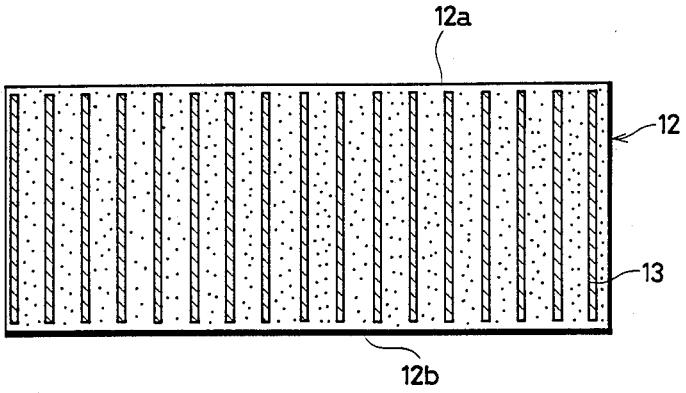
FIG. 3 is a plan view showing the positive temperature coefficient thermistor of FIGS. 2A and 2B at a stage in the fabrication thereof in which a plurality of conductive portions are formed on the upper surface of an organic positive temperature coefficient thermistor sheet.

A plurality of conductive portions 13 are arranged approximately parallel with each other on the upper surface of the sheet 12. FIG. 3 shows a stage in the fabrication of the thermistor 11 in which the plurality of conductive portions 13 are formed on the sheet 12.

As obvious from FIG. 3, each of the conductive portions 13 is formed so as to extend between the vicinities of first and second side edges **12*a* and 12*b* opposed to each other of the sheet 12. It is desirable that the conductive portions 13 are formed to have a length reaching the first and second side edges 12*a* and 12*b*** because they contribute to heat generation.

The conductive portions 13 can be constructed by applying and drying conductive pastes mainly composed of metal materials, such as Ag, Ni or Cu, as shown in FIG. 3, or affixing metal foils such as aluminium foils by a method such as heat pressing so as to be electrically connected to the sheet 12. Even in a case where expensive materials such as Ag pastes are used, the materials are not applied to the whole surface. Accordingly, the cost will not be too high. In addition, even if the conductive portions 13 are formed of metal foils, the metal foils are not applied to the whole surface. Accordingly, the flexibility of the sheet 12 will not be lost.

Turning to FIG. 2A, a plurality of insulating layers 14 are arranged so as to alternately coat the vicinities of respective one ends of the plurality of conductive portions 13. More specifically, the insulating layer 14 is laminated on one end or the other of each of the conductive portions 13 so that the insulating layers 14 are alternately arranged on the side of the first side edge **12*a* and on the side of the second side edge 12*b***.

The insulating layers 14 can be constructed by applying synthetic resins, such as silicone resins, or applying liquid insulating varnish, such as epoxy or phenol resins, and further affixing an insulating pressure sensitive adhesive tape. Briefly stated, the insulating layers 14 may be made of any material provided that they can insulate and coat the alternate one ends of the conductive portions 13, as shown in FIG. 2A.

Additionally, a first power feeding electrode 15 and a second power feeding electrode 16 are respectively formed along the first and second side edges **12*a* and 12*b*. The power feeding electrodes 15 and 16 are respectively formed in the vicinities of the side edges 12*a* and 12*b* so as to extend on the conductive portions 13 between the insulating layers 14 and on the insulating layers 14. Consequently, as shown in FIG. 2B, on the side of the side edge 12*a*, the respective ends of the conductive portions 13, which are not coated with the insulating layers 14, are electrically connected to each other by the first power feeding electrode 15. On the other hand, on the side of the side edge 12*b*, the respective ends of the remaining conductive portions 13 are electrically connected to each other by the second power feeding electrode 16**.

Figure 1:
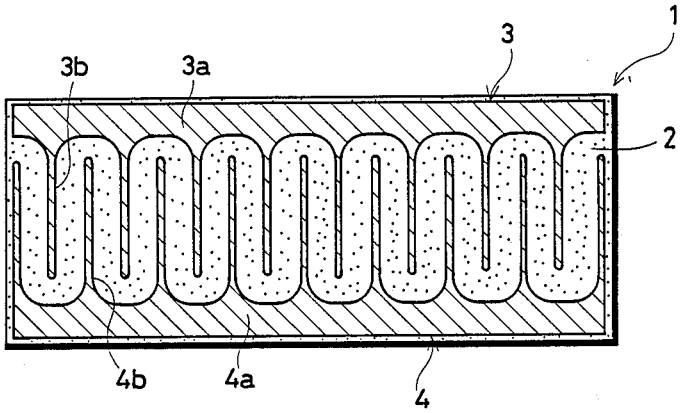
FIG.1 PRIOR ART
FIG. 1 is a plan view for showing a conventional organic positive temperature coefficient thermistor.

Consequently, it is found that the first and second power feeding electrodes 15 and 16 and the conductive portions 13 connected to the respective power feeding electrodes 15 and 16 function similarly to the comb-shaped electrodes 3 and 4 in the conventional example shown in FIG. 1. More specifically, heat is generated in a portion of the organic positive temperature coefficient thermistor sheet 12 between the adjacent conductive portions 13 by energization from the power feeding electrodes 15 and 16. In the present embodiment, the plurality of conductive portions 13 are formed so as to extend between the vicinities of the first and second side edges 12*a* and 12*b*. Accordingly, heat is uniformly generated in almost the entire sheet 12. More specifically, the lower parts of portions where the power feeding electrodes 15 and 16 are provided contribute to heat generation.

Meanwhile, if the conductive portions 13 are formed to have a length reaching the first and second side edges 12*a* and 12*b*, heat is uniformly generated on the whole surface of the sheet 12.

Accordingly, it is found that a face-like heating device can be constructed which generates heat more uniformly and is superior in thermal efficiency, as compared with that in the conventional example shown in FIG. 1. In addition, an electrode is not formed on the whole surface. Accordingly, even if the conductive portions 13 are formed of metal foils, the flexibility is not lost. However, if the conductive portions are formed of Ag pastes, the flexibility which is an advantage of the organic positive temperature coefficient thermistor can be further made use of. In addition, the specific resistance may be the same as that in the conventional example shown in FIG. 1 because an electrode is not formed on the whole surface. Consequently, the variation in characteristics with the product can be effectively decreased.

In order to protect the organic positive temperature coefficient thermistor 11 from the external environment, the surface on which at least the conductive portions 13, the insulating layers 14 and the power feeding electrodes 15 and 16 are formed is coated with an insulating film 17 (represented by the broken line in FIG. 2B).

The invention will be further illustrated by the following specific example of the embodiment shown in FIG. 2.

Carbon black is thoroughly mixed with polyethylene, to form a sheet having a thickness of 0.5 mm. The sheet is cut to a size of 40×100 mm, to obtain a sheet 12. A plurality of conductive portions 13 1 mm in width and 38 mm in length are formed on the upper surface of the sheet 12 by screen-process printing of Ag pastes. The space between the conductive portions 13 is set to 5 mm.

Then, silicone resins are alternately applied in areas of 7×9 mm portions 13 to both ends of the plurality of conductive portions 13 and are hardened, to form insulating layers 14. Finally, Ag pastes 5 mm in width are supplied along side edges 12*a* and 12*b* of the sheet 12 so as to contact the conductive portions 13 between the insulating layers 14 and to contact the insulating layers 14, to form power feeding electrodes 15 and 16.

For comparison, the comb-shaped electrodes 3 and 4 shown in FIG. 1 are formed on the same sheet as the sheet used in the above described embodiment by screen-process printing of Ag pastes.

Figure 4:
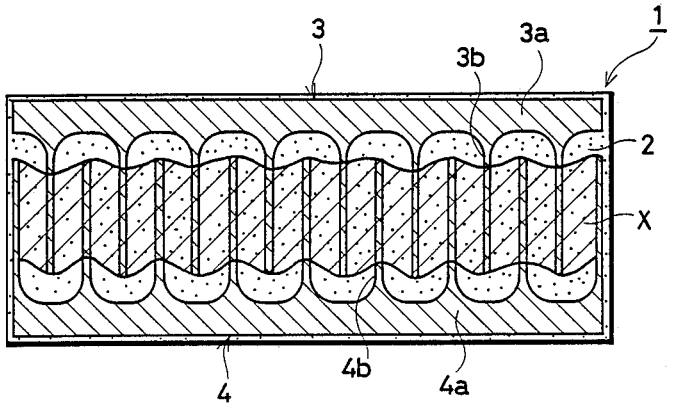
FIG. 4 PRIOR ART
FIG. 4 is a plan view showing a region where heat is generated in the conventional organic positive temperature coefficient thermistor shown in FIG. 1.

A direct current of 12 V is applied between the power feeding electrodes of each of the organic positive temperature coefficient thermistors in the above described embodiment and in the comparative example, to examine heat generation distribution. As a result, in the organic positive temperature coefficient thermistor in the comparative example, heat is generated only in a region X hatched in FIG. 4, that is, a region where the conductive portions 3*b* and 4*b* are overlapped with each other in the direction in which they are arranged. On the other hand, in the organic positive temperature coefficient thermistor in the present embodiment, heat is generated in almost the whole region of the sheet. In addition, the power consumption of the organic positive temperature coefficient thermistor according to the present embodiment is approximately twice that in the comparative example. Consequently, it is found that the thermal efficiency per area is effectively increased.

An example in which a sheet constructed by applying a paste-like organic positive temperature coefficient thermistor material on an insulating film is used as a sheet 12 constitutes a second embodiment of the present invention. Structurally the second embodiment is the same as the first embodiment except for the foregoing, with the same reference numerals assigned to the same portions and, hence, is not specifically illustrated in the Drawings.

In accordance with the second embodiment, a paste-like organic positive temperature coefficient thermistor material obtained by thoroughly mixing silicone rubber with carbon black and toluene is applied in an area of 40×100 mm on an insulating film by screen-process printing and is dried and hardened, to form a sheet 12. Electrodes are formed on this sheet 12 in the same manner as that in the first embodiment, to obtain an organic positive temperature coefficient thermistor 11.

In this second embodiment, a direct current of 12 V is applied between power feeding electrodes to examine heat generation distribution, as in the first embodiment. As a result, heat is uniformly generated in almost the whole surface of the sheet.

An example in which a paste-like organic positive temperature coefficient thermistor material is used as in the second embodiment is constitutes a third embodiment of the present invention. However, the third embodiment differs from the second embodiment in the fabricating method.

Figure 5:
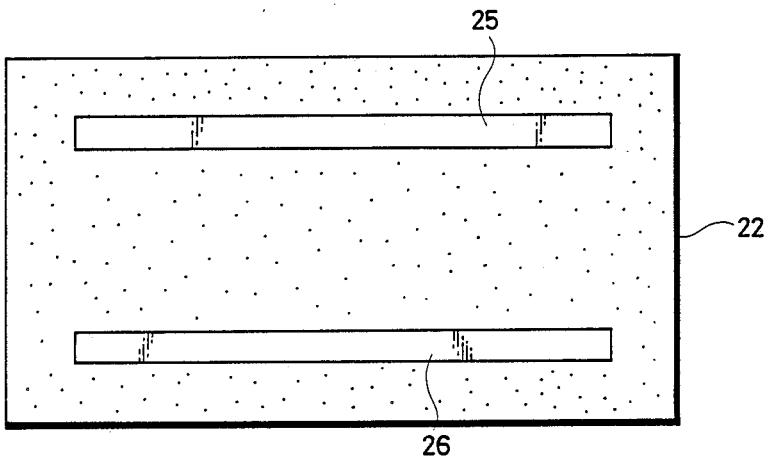
FIG. 5 is a plan view showing power feeding electrodes formed on an insulating film in the process of fabricating an organic positive temperature coefficient thermistor according to an alternative embodiment of the present invention.
Figure 6:
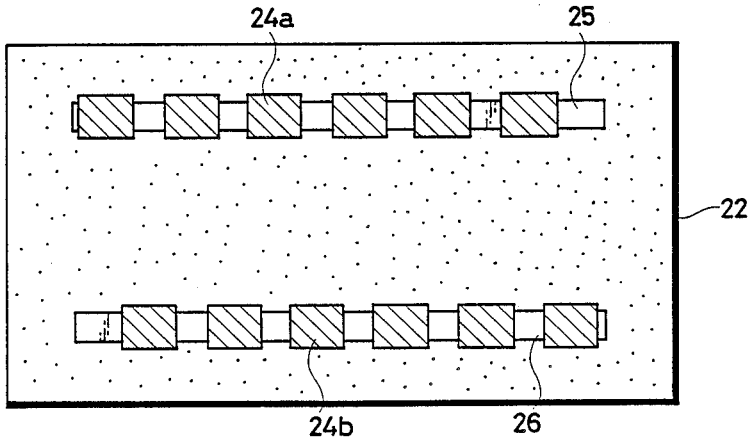
FIG. 6 is a plan view showing a stage in the fabrication of the alternative embodiment in which insulating layers are formed.

First, as shown in FIG. 5, Ag pastes 5 mm in width and 98 mm in length and spaced 30 mm apart are applied on an insulating film 22 to form a pair of power feeding electrodes 25 and 26. Silicone resins are alternately applied in areas of 7×9 mm as insulating layers on the pair of power feeding electrodes 25 and 26 and then, are dried, to form insulating layers 24*a* and 24*b* (see FIG. 6).

Figure 7:
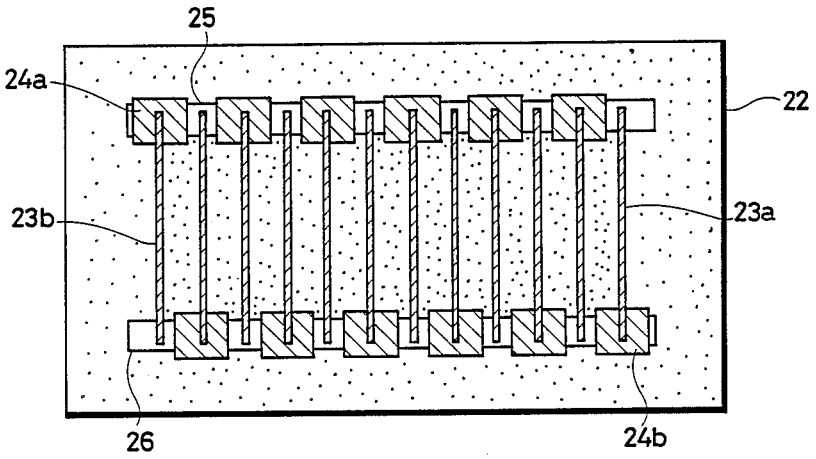
FIG. 7 is a plan view showing a a stage in the fabrication of the alternative embodiment in which conductive portions are formed.
Figure 8:
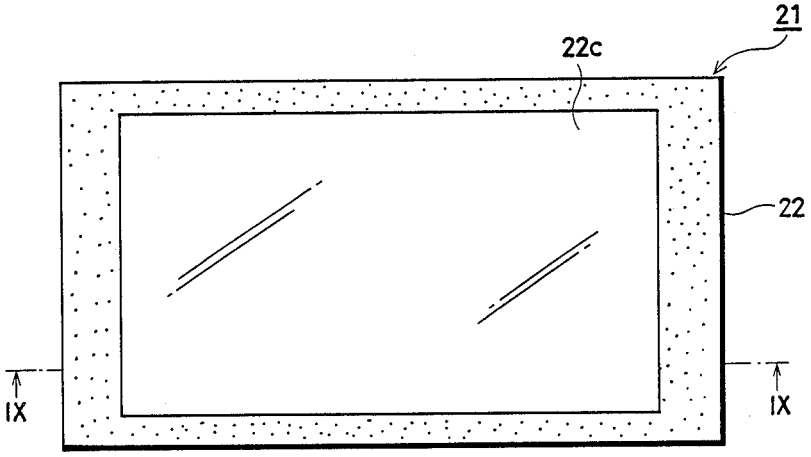
FIG. 8 is a plan view illustrating a completed organic positive temperature coefficient thermistor according to an alternative embodiment of the present invention.
Figure 9:
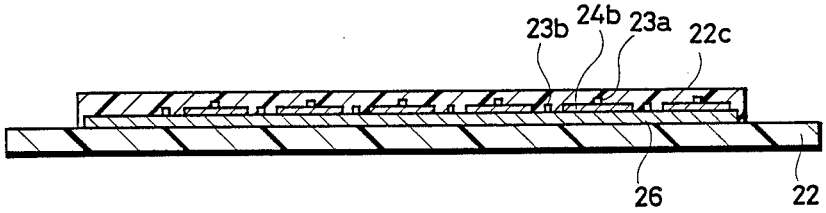
FIG. 9 is a cross-sectional view taken along a line IX—IX shown in FIG. 8.

Furthermore, as shown in FIG. 7, Ag pastes 1 mm in width and 38 mm in length are applied and are dried so as to form conductive portions 23*a* which are in contact with the power feeding electrodes 25 and the insulating layers 24*b* formed on the power feeding electrode 26 and to form conductive portions 23*a* which are in contact with the power feeding electrode 26 and the insulating layers 24*a* formed on the power feeding electrode 25. Thereafter, a paste-like organic positive temperature coefficient thermistor material 22*c* identical to that used in the second embodiment is applied in an area of 50×100 mm by screen-process printing and is dried and hardened, to obtain an organic positive temperature coefficient thermistor 21 (see FIGS. 8 and 9).

Also in this third embodiment, a direct current of 12 V is applied to examine heat generation distribution, as in the first and second embodiments. As a result, heat is generated in almost the whole surface of the sheet.

Although in the second and third embodiments, a paste-like organic positive temperature coefficient thermistor material is applied on an insulating film, the present invention is not limited to the same. For example, an insulating plate such as an alumina substrate may be used in place of the insulating film.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An organic positive temperature coefficient thermistor, comprising:

a sheet having a positive temperature characteristic of resistance and comprised of conductive particles dispersed in an organic polymer material;

a plurality of conductive portions extending between first and second opposed side edges of the sheet and arranged substantially parallel with each other on one surface of the sheet with respective first ends of the portions at or adjacent to the first edge and respective, opposed second ends at or adjacent to the second edge of the sheet;

an insulating layer on a part of each conductive portion adjacent to one end or the other end of each conductive portion so that alternate ones of the respective first and second ends of the conductive portions have insulating layers thereon;

first and second power feeding electrodes respectively formed along the first and second side edges so as to extend on the insulating layers and on the part of the conductive portions between the insulating layers in order to electrically connect alternate ones of the first ends of the conductive portions to the first power feeding electrode and to electrically connect alternate ones of the second ends of the conductive portions to the second power feeding electrode.

2. The organic positive temperature coefficient thermistor of claim 1, wherein the conductive portions are formed of conductive pastes.

3. The organic positive temperature coefficient thermistor of claim 1, wherein the conductive portions are formed of metal foils.

4. The organic positive temperature coefficient thermistor of claim 1, wherein the plurality of conductive portions are formed to have a length such that both ends thereof reach the first and second side edges.

5. The organic positive temperature coefficient thermistor of claim 1, which further comprises an insulating film for coating the plurality of conductive portions, the plurality of insulating layers and the first and second power feeding electrodes.

6. A method of fabricating an organic positive temperature coefficient thermistor, comprising the steps of:

forming a sheet from a material which has a positive temperature characteristic of resistance and which is comprised of conductive particles dispersed in an organic polymer material;

forming on the sheet a plurality of conductive portions with the conductive portions extending between first and second opposed side edges and arranged substantially parallel with each other and with respective first ends of the conductive portions at or adjacent to the first side edge and respective, opposed second ends of the conductive portions at or adjacent to the second side edge of the sheet;

forming an insulating layer on a part of each conductive portion adjacent to one end or the other end of each conductive portion so that alternate ones of the respective ones of the respective first and second ends of the conductive portions have insulating layers thereon;

forming first and second power feeding electrodes along the first and second side edges, respectively, so as to extend on the insulating layers and on part of the conductive portions located between the insulating layers in order to electrically connect alternate ones of the first ends of the conductive portions to the first power feeding electrode and to electrically connect alternate second ones of the ends of the conductive portions to the second power feeding electrode.

7. The method of claim 6, wherein the plurality of conductive portions are formed by applying conductive pastes on one surface of said sheet and then drying said pastes.

8. The method of claim 6, wherein the plurality of conductive portions are formed by affixing a plurality of metal foils to one surface of the sheet.

9. The method of claim 6, which further comprises the step of affixing an insulating film so as to coat the plurality of conductive portions, the plurality of insulating layers and the first and second power feeding electrodes.

10. The method of claim 6, wherein the sheet is formed by applying a paste-like organic positive temperature coefficient thermistor material comprised of conductive particles and an organic polymer material to an insulating film and drying the same.

11. A method of fabricating an organic positive temperature coefficient thermistor, comprising the steps of:

forming an insulating substrate;

forming first and second, spaced power feeding electrodes on one surface of the insulating substrate;

forming a plurlaity of spaced insulating layers on the first and second power feeding electrodes;

forming a plurality of conductive portions such that the conductive portions are arranged substantially parallel with each other with respective first ends of the conductive portions alternately contacting the first power feeding electrode and the insulating layers thereon and with respective opposed, second ends of the conductive portions alternately contacting the second power feeding electrode and the insulating layers thereon; and applying a paste-like organic positive temperature coefficient thermistor material to the first and second power feeding electrodes, the plurality of insulating layers and the plurality of conductive portions and then drying the same.

* * * * *